US006619813B1

(12) United States Patent
Schnell

(10) Patent No.: US 6,619,813 B1
(45) Date of Patent: Sep. 16, 2003

(54) MULTI-PURPOSE LED LIGHT

(75) Inventor: Tim Schnell, Bedford, TX (US)

(73) Assignee: IP Holdings, Inc., Houston, TX (US)

( * ) Notice: Subject to any disclaimer, the term of this patent is extended or adjusted under 35 U.S.C. 154(b) by 0 days.

(21) Appl. No.: 10/101,542

(22) Filed: Mar. 19, 2002

(51) Int. Cl.[7] ..... F21V 33/00

(52) U.S. Cl. ..... 362/116; 362/396; 362/285; 362/200; 362/800

(58) Field of Search ..... 362/116, 800, 362/285, 287, 295, 200, 201, 396, 190, 191, 421

(56) References Cited

U.S. PATENT DOCUMENTS 5,448,459 A * 9/1995 Rogers ..... 362/191
5,460,346 A * 10/1995 Hirsch ..... 248/229.13
6,161,938 A * 12/2000 Kish et al. ..... 362/183
6,224,235 B1 * 5/2001 Parker ..... 362/190

* cited by examiner

*Primary Examiner*—Sandra O'Shea
*Assistant Examiner*—Ali Alavi
(74) *Attorney, Agent, or Firm*—Schwegman, Lundberg, Woessner & Kluth, P.A.

(57) ABSTRACT

A light includes a body having a power source mounted within the body, an LED coupled to the body and exposed on a surface of the body, a switch mounted to the body for controlling an electrical connection between the power source and the LED, and a clip member removably mountable to the body. The clip member can include a swivel joint to permit the body to be oriented in a plurality of positions when the body is mounted to the clip member. The body can include a first mounting portion for removably mounting a key-ring to the body and a second mounting portion for removably mounting the clip to the body.

26 Claims, 3 Drawing Sheets

MULTI-PURPOSE LED LIGHT

FIELD OF THE INVENTION

This invention relates to the field of lights, and more specifically to a multi-purpose light.

BACKGROUND

Flashlights are typically hand-held and it is difficult to position such a light precisely where it is needed without continually holding and manipulating the light. Headlamps are lights which provide for hands-free illumination by providing a clip for mounting the light to clothing or a hat brim. These headlamps typically include a light in a cylindrical body which holds one or more batteries. The batteries typically are at least AAA size batteries even for the smallest headlamps. These result in a bulky structure, without ease of maneuverability. In some headlamps, the batteries are stored in the clip base and wires are run up to a light. This limits movement of the light so as to avoid damaging the wires.

SUMMARY

The present invention provides a multi-purpose light. One aspect includes a light comprising a body having a power source mounted within the body, an LED coupled to the body and exposed on a surface of the body, and a switch mounted to the body for controlling an electrical connection between the power source and the LED. A clip member is removably mountable to the body. The clip member can include a swivel joint to permit the body to be oriented in a plurality of positions when the body is mounted to the clip member.

Another aspect includes a light comprising a body having a power source mounted therein, a light source coupled to the body and connectable to the power source, and a switch for controlling an electrical connection between the light source and the power source. The body includes a first mounting portion for removably mounting a key-ring to the body and a second mounting portion for removably mounting a clip to the body.

DETAILED DESCRIPTION

In the following detailed description, reference is made to the accompanying drawings which form a part hereof, and in which is shown by way of illustration specific embodiments in which the invention may be practiced. These embodiments are described in sufficient detail to enable those skilled in the art to practice the. invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

Figure 1:
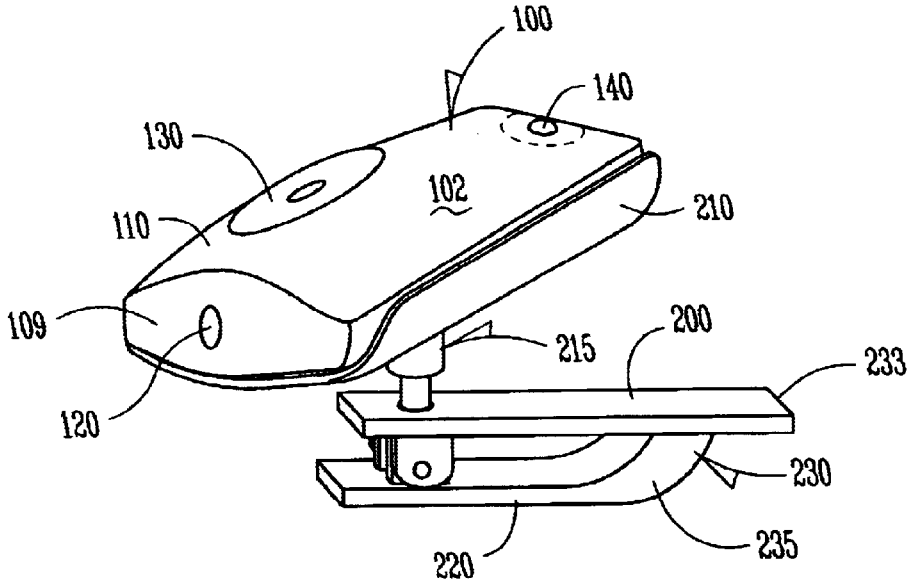
FIG. 1 shows a perspective view of a light mounted in a swivel clip according to one embodiment of the present invention.

FIG. 1 shows a perspective view of a light 100 mounted in a swivel clip 200. Light 100 is removably mounted to clip 200 and is adaptable for being used as both a handheld key-chain light when removed from the clip, and as a hands-free light source by being clipped to an object using clip 200. The clip can be used to clip the light to a hat brim or visor, a shirt pocket, a belt, a book, or other object.

Light 100 generally includes a main body 110, a light source 120, and a switch 130. An example body 110 includes a plastic shell body and is dimensioned to fit comfortably within a user's hand. For example, one embodiment has the approximate dimension of approximately 1.5 inches long, 1 inch wide, and ½ inch thick. Body 110 includes a generally flattened configuration defined by a top surface 102, a bottom surface, and side walls extending between the top and bottom surfaces. Top surface 102 can be contoured, having a slight raised portion in the middle of the light, to provide a comfortable, solid feeling to the light when holding the light in the hand. Light source 120, such as a light emitting diode (LED), is mounted to the light such that the LED is exposed on a front surface 109 of the body. The LED can be a white LED, or other colored LED, depending on use.

A rear portion of body 110 includes a mounting section 140 for mounting a key-ring or key chain to body 10, as will be discussed below. In one example, mounting section 140 includes a hole extending through body 110. Body 110 is removably mountable to clip 200. This allows light 100 to be used in the clippable configuration of FIG. 1 and also to alternatively be used as a key-chain light.

Clip 200 can be a swivel clip having a top section 210 and a bottom section 220 which are joined at a swivel joint 215. One example of a swivel joint 215 is a ball-and-socket joint. This allows top section 210 of clip 200 to rotate and swivel in any direction relative to bottom section 220. Since the power source of the present light is included in the light body, no wires need be run from the clip up to the light. This allows for a highly maneuverable swivel joint. Top section 210 includes mounting means to allow light 100 be removably mounted to clip member 200.

Bottom section 220 includes a clip section 230 which includes an upper jaw member 233 and a lower jaw member 235. These jaw members can be spring-loaded to bias the clip towards a closed position. A user squeezes the opposite ends of jaw members 233 and 235 to open the jaws to engage the clip onto an object such as the visor of a hat.

Figure 2:
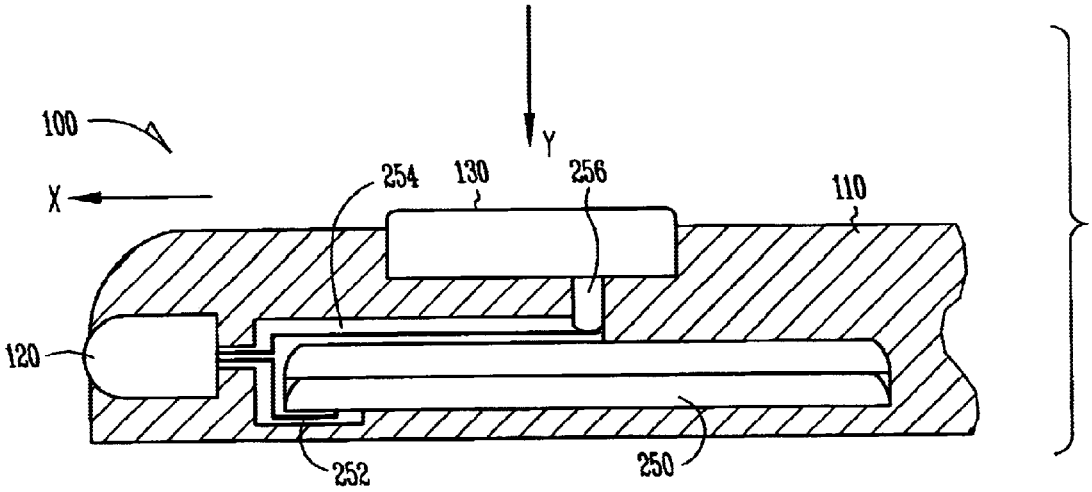
FIG. 2 shows a side cross-section of the light of FIG. 1.

FIG. 2 shows a cross-section side view of a portion of light 100. Light 100 includes a power source 250 mounted therein. In one example, power source 250 includes two CR 2016 batteries. These lightweight, flat, thin batteries allow light body 110 to have a slim, compact shape, and do not result in a bulky, hard to maneuver light. Other flat batteries or button batteries can also be used as a power source for the light. A pair of connectors 252 and 254 connect power source 250 to LED 120. LED 120 can be dimensioned as desired. In one example an LED is used having an approximately 5.0 mm diameter and a length of approximately 5.0 mm to 7.0 mm. Other sizes of LEDs can also be used and are within the scope of the present system.

Top surface 102 of body 110 includes a switch 130 to operate light 100. In one embodiment, switch 130 is a dual-activated switch allowing light 100 to be turned on by at least two different connection techniques or connection mechanisms. In one technique of using switch 130, the switch is slid forward relative to the light body (in direction X) until the switch catches on a catch or detent means within light body 110. An actuator 256 on the switch forces contact 254 against the battery, thus making the electrical connection between the battery and LED 120. When switch 130 is slid backwards away from the catch, contact 254 biases upward and the connection is broken.

In the second technique of using switch 130, switch 130 acts as a usually-open momentary switch. A user presses down (in direction Y) on switch 130 until actuator 256 forces contact 254 against battery 250. In this configuration, the connection is broken as soon as the user lets go of the switch and the switch and contact 254 bias upwards. Thus, a user can use the light in a hands-free manner by pushing the switch forward (direction X) to activate the light, or the light can be activated by pressing down (direction Y) on the switch for momentary illumination.

Figure 3:
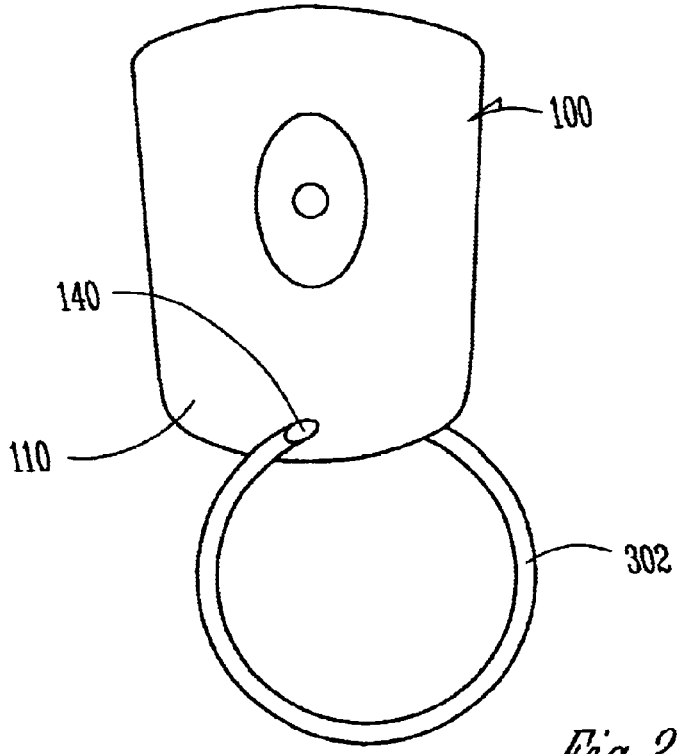
FIG. 3 shows a top view of the light of FIG. 1 mounted to a key-ring.

FIG. 3 shows a top view of light 100 having a key-ring 302 mounted to mounting hole 140 of body 110. Mounting hole 140 can hold a key chain, key-ring or other item. In this example, light 100 has approximate dimensions of 38 mm wide and 42 mm long.

Figure 4:
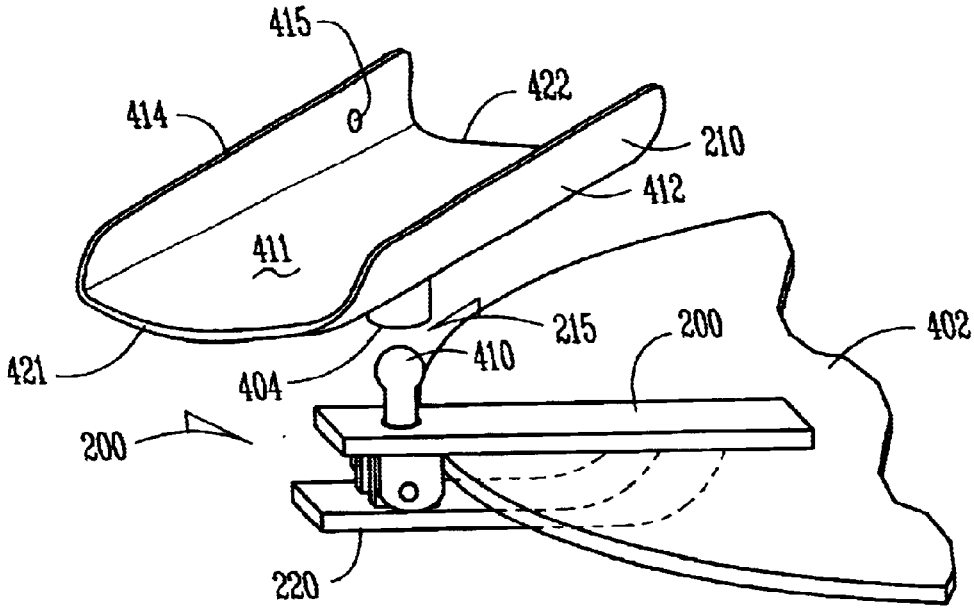
FIG. 4 shows a perspective, exploded view of the swivel clip of FIG. 1.

FIG. 4 shows a perspective, exploded view of swivel clip 200 according to one embodiment. Clip 200 is clipped to a visor 402. Top section 210 of clip 200 includes a bottom surface 411 having two side walls 412 and 414 extending therefrom. In one embodiment, each side wall 412 and 414 includes a catch 415 for catching a mating portion of light 100 (FIG. 1) therein. Side walls 412 and 414 have a diverging orientation relative to each other. They are farther apart near a front 421 of the clip and nearer together at a back 422 of the clip. This angled orientation allows for easy mounting and better grip of light 100 when it is mounted within top section 210 since the light body 110 includes a matching or corresponding angled shape. (See FIG. 3 for a top view showing the angled sides of light 100). Thus, the light can slide into top section 210 and be oriented correctly.

In this example, top section 210 includes a socket 404. This matingly receives a ball 410 of bottom section 220. Ball 410 is slightly larger than cavity socket 404 thus frictionally holding top section 210 stable however a user adjusts it. In some embodiments, top section 210 and bottom section 220 can be a one-piece design with joint 215 being stiffened, flexible wire, a hinged joint, or other type of movable joint structure.

Figure 5:
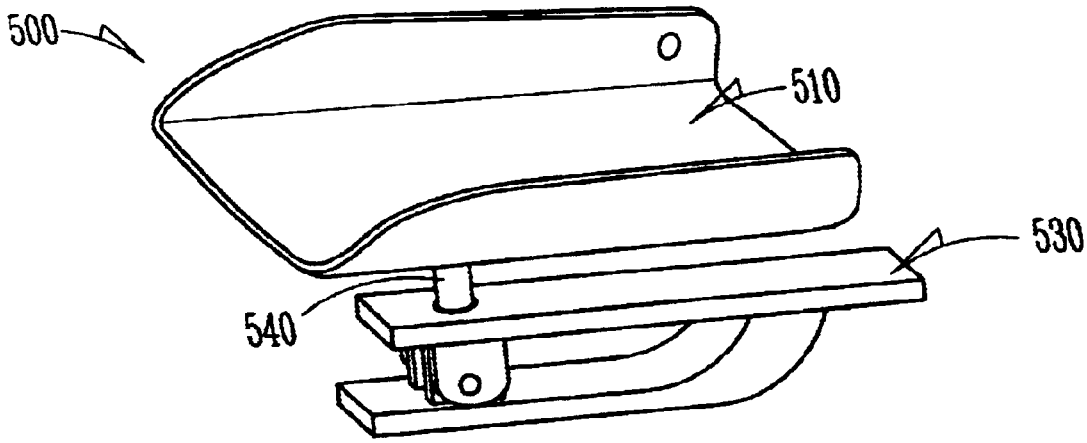
FIG. 5 shows a perspective view of a light clip according to one embodiment.

FIG. 5 shows a perspective view of a light clip 500 according to one embodiment. Light clip 500 includes a clip portion 530 allowing clip 500 to be clipped to a visor or other object as detailed above for clip 200. Clip 500 includes a light mounting area 510 for removably mounting a light such as light 100. Other features of clip 500 are similar to clip 200. However, clip 500 does not include a swivel joint. Instead, a rigid post 540 couples the top and bottom portions of the clip together. In some examples, the post is omitted and the top portion is directly mounted to the bottom portion.

The present system provides a light which includes a body having a power source mounted within the body, an LED coupled to the body and exposed on a surface of the body, a switch mounted to the body for controlling an electrical connection between the power source and the LED, and a clip member removably mountable to the body. The clip member can include a swivel joint to permit the light to be oriented in a plurality of positions when it is mounted to the clip member. The light can include a first mounting portion for removably mounting a key-ring to the body of the light and a second mounting portion for removably mounting the clip to the light. Among other advantages, these features allow for the light to be used as either a hat-clip light or a key-chain light. When used as a hat-clip light, the light includes the power source, light source, and switch all within a single body. This allows the light to be completely movable since no wires need to be run up to the light. Moreover, in one embodiment, the LED of the present light only requires thin, lightweight batteries, thus providing an overall lightweight, maneuverable hat-clip light.

It is understood that the above description is intended to be illustrative, and not restrictive. Many other embodiments will be apparent.to those of skill in the art upon reviewing the above description. The scope of the invention should, therefore, be determined with reference to the appended claims, along with the full scope of equivalents to which such claims are entitled.

What is claimed is:

1. A light comprising:

a light body having a power source mounted therein, the light body being a generally flat body having a top surface, a pair of opposing side surfaces, and a front surface;

a light source coupled to the light body and connectable to the power source, wherein the light source is positioned to be exposed on the front surface of the body; and a switch mounted to the top surface of the light body, the switch for controlling an electrical connection between the light source and the power source;

wherein the light body includes a first mounting portion for removably mounting a key-ring to the light body and wherein the light body also includes a second mounting portion for removably mounting a clip to the side surfaces of the light body.

2. The light of claim 1, wherein the power source includes one or more flat batteries.

3. The light of claim 1, wherein the light includes an LED.

4. The light of claim 3, wherein the LED includes a white LED.

5. A light comprising:

a light body having a power source mounted therein;

a light source coupled to the light body and connectable to the power source; and a switch for controlling an electrical connection between the light source and the power source;

wherein the light body includes a first mounting portion for removably mounting a key-ring to the light body and wherein the light body also includes a second mounting portion for removably mounting a clip to the light body, wherein the switch includes two actuation configurations, wherein a first actuation configuration includes moving the switch in a first direction and into and out of a detent position for making and breaking the electrical connection and wherein the second actuation configuration includes moving the switch in a second direction to make the electrical connection wherein the switch is biased away when the switch is released.

6. A light system comprising:

a body having a power source mounted within the body, an LED coupled to the body and exposed on a surface of the body, and a switch mounted to the body for controlling an electrical connection between the power source and the LED; and a clip member removably mountable to the body, wherein the clip member includes a swivel joint to permit the body to be oriented in a plurality of positions when the body is mounted to the clip member.

7. The light system of claim 6, wherein the body is a generally flattened body and the LED is positioned to be exposed on a front surface of the body.

8. The light system of claim 6, wherein the power source includes two CR 2016 batteries.

9. The light system of claim 6, wherein the switch is actuatable in both a first direction and a second direction to close the electrical connection between the LED and the power source.

10. The light system of claim 6, wherein the switch includes two connection mechanisms, wherein a first connection mechanism includes moving the switch into and out of a detent position for making and breaking the electrical connection, and wherein a second connection mechanism includes moving the switch in a second direction to make the electrical connection wherein the switch is biased into an open position when the switch is released.

11. The light system of claim 6, wherein the LED is a white LED.

12. The light system of claim 6, wherein the clip member is adapted to releasably clip the clipping member to a visor of a cap.

13. The light system of claim 6, wherein the body includes a mounting section for removably connecting the body section to a key ring.

14. The light system of claim 6, wherein the clip member includes a pair of angled side walls and the light body includes a corresponding angled shape which approximately matches the shape of the pair of angled side walls.

15. The light of claim 5, wherein the power source includes one or more flat batteries.

16. The light of claim 5, wherein the light includes an LED.

17. The light of claim 16, wherein the LED includes a white LED.

18. A light comprising:

a body having a power source mounted within the body;

a light source coupled to the body and exposed on a surface of the body;

a switch mounted to the body for controlling an electrical connection between the power source and the light source, wherein the switch is actuatable in both a first direction and a second direction to close the electrical connection between the light source and the power source; and a clip member removably mountable to the body.

19. The light of claim 18, wherein the switch includes two connection mechanisms, wherein a first connection mechanism includes moving the switch into and out of a detent position for making and breaking the electrical connection, and wherein a second connection mechanism includes moving the switch in a second direction to make the electrical connection wherein the switch is biased into an open position when the switch is released.

20. The light of claim 18, wherein the body includes a mounting section for removably connecting the body section to a key ring.

21. A light comprising:

a light body having a power source mounted within the body, the light body having a pair of side walls;

a light source coupled to the light body and exposed on a surface of the body;

a switch mounted to the light body for controlling an electrical connection between the power source and the light source; and a clip member removably mountable to the light body, wherein the clip member includes a pair of angled side walls and the light body side walls have a corresponding angled shape which approximately matches the shape of the pair of angled side walls of the clip member.

22. The light of claim 21, wherein the light body includes a mounting section for removably connecting the body to a key ring.

23. The light of claim 21, wherein the body is a generally flattened body and the light source is positioned to be exposed on a front surface of the body.

24. A light comprising:

a body having a power source mounted within the body, an LED coupled to the body and exposed on a surface of the body, and a switch mounted to the body for controlling an electrical connection between the power source and the LED, wherein the body is a generally flattened body and the LED is positioned to be exposed on a front surface of the body, wherein the light body includes a first mounting portion for removably mounting a key-ring to the light body and wherein the light body also includes a second mounting portion for removably mounting a clip member to the light body; and a clip member removably mountable to the body, wherein the clip member includes a pair of angled side walls and the light body includes a corresponding angled shape which approximately matches the shape of the pair of angled side walls.

25. The light of claim 24, wherein the switch is actuatable in both a first direction and a second direction to close the electrical connection between the LED and the power source.

26. The light of claim 25, wherein the switch includes two connection mechanisms, wherein a first connection mechanism includes moving the switch into and out of a detent position for making and breaking the electrical connection, and wherein a second connection mechanism includes moving the switch in a second direction to make the electrical connection wherein the switch is biased into an open position when the switch is released.

* * * * *